United States Patent [19]

Nakabayashi et al.

[11] Patent Number: 4,472,885

[45] Date of Patent: Sep. 25, 1984

[54] PROCESS AND APPARATUS FOR DEHYDRATING ORGANIC SOLID MATERIAL

[75] Inventors: Yasuyuki Nakabayashi, Yokohama; Yoshio Matsuura, Funabashi; Michio Kurihara, Mitaka; Takao Kamei, Ashiya; Akira Nakamura; Keiichi Komai, both of Akashi, all of Japan

[73] Assignee: Electric Power Development Co., Ltd., Tokyo; Kawasaki Jukogyo Kabushiki Kaisha, Kobe, both of Japan

[21] Appl. No.: 343,719

[22] Filed: Jan. 28, 1982

[51] Int. Cl.[3] ..... F26B 3/00

[52] U.S. Cl. ..... 34/9; 34/15; 34/22; 34/35

[58] Field of Search ..... 34/36, 35, 22, 9, 15; 110/224; 134/104, 109; 44/1 G, 2

[56] References Cited

U.S. PATENT DOCUMENTS 1,679,078 7/1928 Fleissner ..... 34/37

3,007,254 11/1961 Schuster ..... 34/35

*Primary Examiner*—Larry I. Schwartz

*Assistant Examiner*—David W. Westphal

*Attorney, Agent, or Firm*—Kerkam, Stowell, Kondracki & Clarke

[57] ABSTRACT

There is disclosed a process for dehydrating organic porous material such as brown coal. The process comprises steps of charging the material to a plurality of pressure vessels and filling at least one of the pressure vessels with water, carrying out a dehydration step by supplying steam to the vessel which is filled with water to heat the material therein while exhausting water from that vessel to thereby lower the water surface in the vessel so that the material therein is gradually exposed to the steam and water in the material is removed and mixed with condensed steam to form hot water, transferring the hot water from said first vessel to a substantially top portion of a second vessel while continuously supplying the steam to the first vessel until the second vessel is substantially filled with the hot water, and then expelling the hot water from a substantially bottom portion of the second vessel by the hot water which is transferred from the first vessel to the second vessel. As soon as the water in the first vessel is exhausted, the first vessel is separated from the other vessels and depressurized. An apparatus for carrying out such process is also disclosed.

6 Claims, 2 Drawing Figures

PROCESS AND APPARATUS FOR DEHYDRATING ORGANIC SOLID MATERIAL

Figure 1:
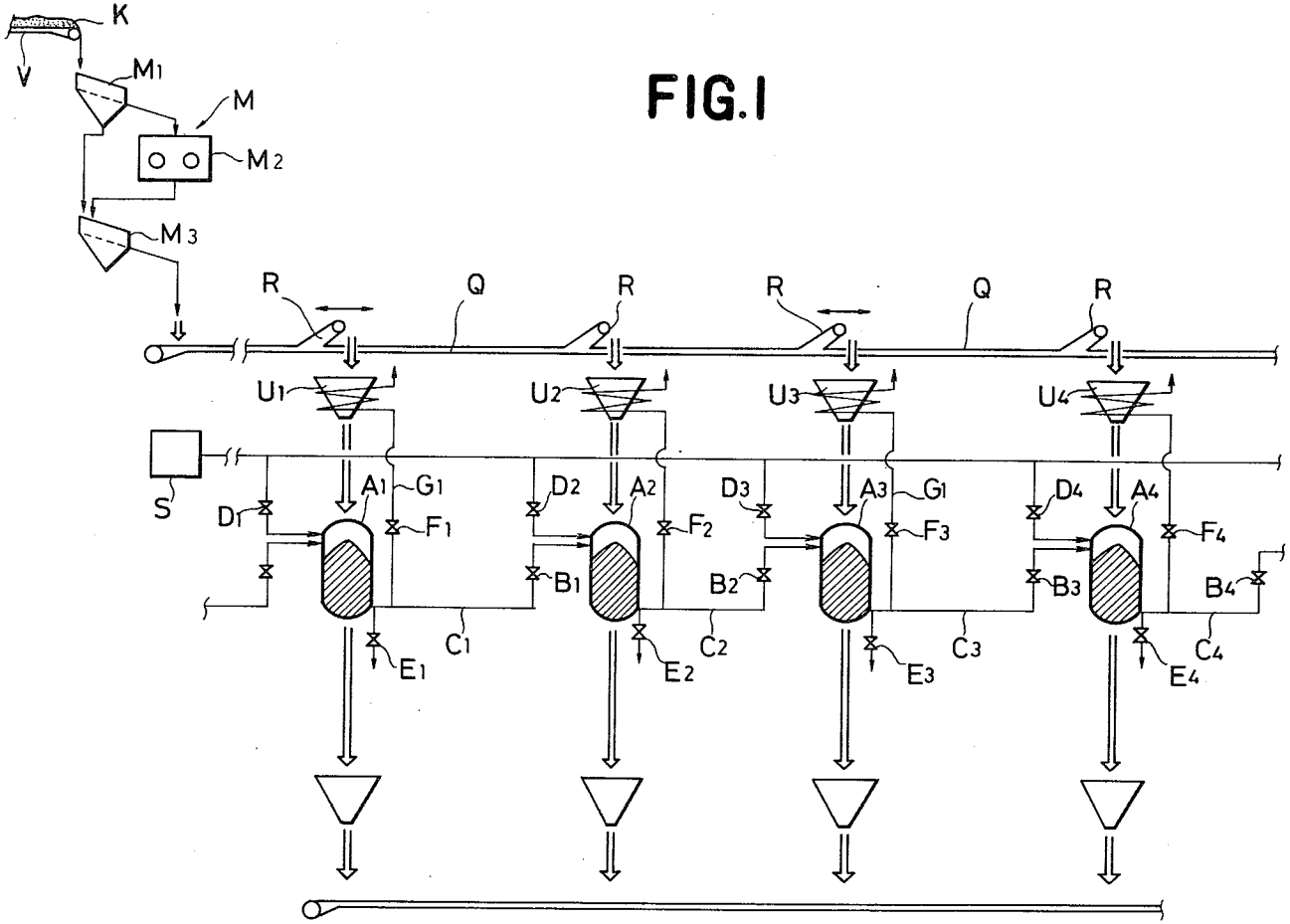

The present invention relates to a dehydrating process and more particularly to a process for dehydrating porous materials such as brown coal which can be dehydrated under an atmosphere in which water cannot be evaporated.

Hithertofore, dehydration of solid material such as brown coal has been carried out by an evaporation process such as a dry air process or an indirect heating process. These processes, however, have disadvantages in that the heat consumption is excessive, that the material has to be crushed in advance and that the dust is produced upon dehydration. Further, fire is likely to occur in the dehydrated material.

In order to eliminate the above disadvantages, a liquid form dehydration process has been developed. The process utilizes the liquid form dehydration phenomenon in which physical and chemical changes are produced in a porous solid material such as brown coal when it is heated under a non-evaporating atmosphere with the result that water in liquid form is removed from pores in the solid material. To carry out the liquid form dehydration, the Australian Pat. No. 430626 proposes to heat the material in water under a pressure higher than the saturated vapour pressure. This process is, however, disadvantageous in that water may be drawn again into the material when the dehydrating vessel is depressurized. As an alternative process, it has been proposed to heat the material in an atmosphere of saturated steam. In actual practice, the saturated steam process is carried out by using a plurality of pressure vessels in which batch processes are proceeded with phase differences between the vessels. In one of typical processes, the brown coal to be dehydrated is sieved to remove fine particles and put into the vessels with time differences. Each of the vessels is then closed and after an appropriate preheating step supplied with saturated steam to have the coal therein heated thereby so that water in the coal is removed in liquid form. The removed water is mixed with condensed steam to produce hot water which is introduced into a hot water reservoir. The vessel is thereafter depressurized so that the residual water in the brown coal is further evaporated.

The liquid form dehydrating process utilizing the saturated steam is characterized in that lumps of organic solid material of a substantial size can be dehydrated as they are, and thermal efficiency can be improved significantly as compared with an evaporating process, however, it has disadvantages in that the hot water reservoir must be provided one for each pressure vessel so that a bulky system is required for dehydration. Further, there is a substantial difference in the steam flow between the beginning and the end period of the heating step since the pressure in the pressure vessel and the temperature of the coal significantly change during the step, so that it is required to provide a large capacity steam generator or a large capacity steam accumulator. It should further be noted that in the preheating step the transfer of the heating medium such as the hot water and the steam is carried out under a pressure difference between the pressure vessels, so that it is impossible to transfer the waste water which has been used for the preheating to a further vessel for recovering the heat therein although the waste water has a substantial heat due to the fact that the heat exchange time in the preheating step is insufficient.

In the conventional process, there is a further problem in that the heat in the waste water cannot be sufficiently recovered. The hot water as produced in the first vessel in the heating step is at once stored in a reservoir and then introduced into the second vessel which is in a preheating step to apply the heat in the water to the material in the vessel. The steam in the first vessel is also introduced into a third vessel to heat the material therein. The water as introduced into the second vessel flows downward through the layer of the brown coal without filling the vessel and a heat exchange is performed between the water and the coal before the water is exhausted from the vessel. Thus, the contact time between the hot water and the coal is not sufficient to conduct an adequate heat exchange.

It is therefore an object of the present invention to provide a process for dehydrating porous organic solid material in which the liquid form dehydration phenomenon can be effectively utilized.

Another object of the present invention is to provide a dehydrating process which possesses the preheating effect of the hot water dipping process and the effective dehydration as obtained by the saturated steam process.

A further object of the present invention is to provide an apparatus for carrying out such dehydrating process.

According to the present invention, the above and other objects can be accomplished by a process for dehydrating organic solid material which comprises steps of providing a plurality of pressure vessels at least one of which is filled with the material and water, carrying out a dehydration step by supplying steam to said one of the vessels to heat the material therein while removing the waste from said one vessel to thereby lower water level in the one vessel so that the material is gradually exposed to the steam and water in the material be removed and mixed with condensed steam to form hot water, transferring the hot water from said first vessel to a substantially top portion of a second vessel while continuously supplying the steam to said one vessel until said second vessel is substantially filled with the hot water, and then expelling the hot water from a substantially bottom portion of the second vessel by the hot water which is transferred from the one vessel to the second vessel until the water in the one vessel is exhausted. In a preferable mode of the present invention, the hot water expelled from the second vessel is transferred further to a suitable number of pressure vessels to fill them in series sequence by taking out the hot water from a substantially bottom portion of a preceding vessel to a substantially top portion of a succeeding vessel, the hot water in the pressure vessel which is in a downstream end being expelled from a substantially bottom portion thereof.

After the dehydration step is completed in the first vessel, it is isolated from the second vessel and depressurized and the material which has been dehydrated is taken out of the first vessel to complete one cycle of dehydration. Thereafter, the first vessel or a further vessel is charged with the material and the steam is supplied to the second vessel to carry out a further cycle of dehydration. In a similar manner, dehydration cycles are carried out in series sequence in all of the vessels.

The vessel in which the dehydration cycle is carried out may be isolated from the other vessels when the hot water in the particular vessel be exhausted or steam is started to be supplied to the vessel next to the particular vessel. In actual practice, said further vessel may be substituted by said first vessel so that the dehydration cycles be proceeded in series sequence in the vessels which are connected in a circular chain. The number of the vessels should preferably be as large as possible in view of the thermal efficiency, however, no further merits will be obtained if the number is increased beyond twenty.

The present invention further provides an apparatus for carrying out the process described above. In connecting the vessels, the top portion of one vessel may be connected through a conduit having a valve with the bottom portion of the upstream side vessel and the bottom portion of the one vessel through a further conduit having a further valve with the top portion of the downstream side vessel.

According to the features of the present invention, it is possible to eliminate the hot water reservoirs which have been required in conventional apparatus. Since the preheating is conducted by filling the vessels with the hot water, an adequate heat exchange can be ensured. Further, it is possible to recover heat even from the water of the temperature below 100° C. In the specific pressure vessel which is being supplied with steam, the material which is below the water surface is considered as being in the final stage of the preheating and the dehydration taken place in the material exposed to the steam. Steam is continuously supplied to the vessel and gradually displaces the water therein. Thus, it is not necessary to supply a large amount of steam within a limited time. Since the dehydration takes place in the atmosphere of saturated steam, it is unlikely that the hot water is again drawn back into the material when the vessel is depressurized.

Figure 2:
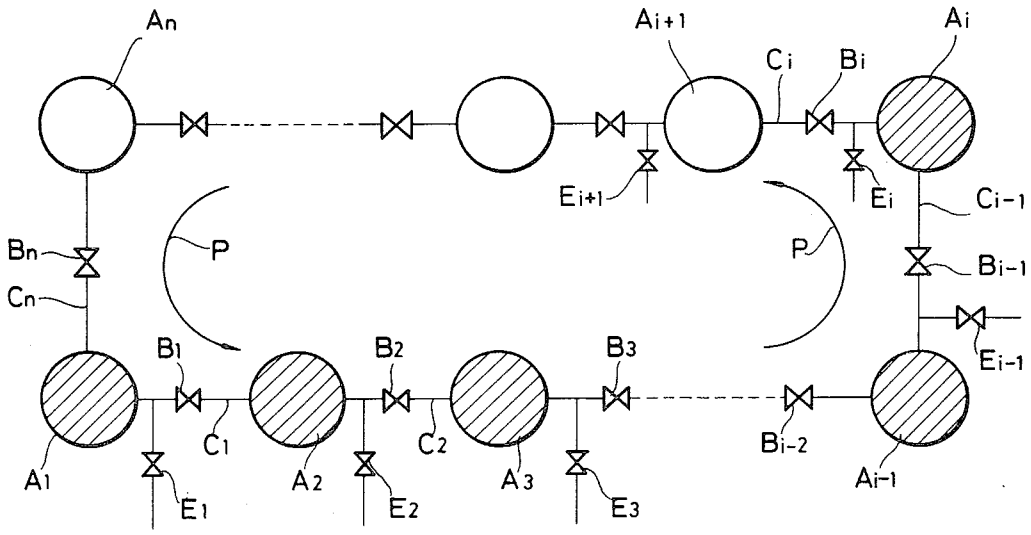

The above and other objects and features of the present invention will become apparent from the following descriptions of a preferred embodiment taking reference to the accompanying drawings, in which;

FIG. 1 is a schematic diagram of an example of the dehydrating system for carrying out the process of the present invention; and FIG. 2 is a diagram showing one example of the sequential operation of the present invention.

Referring to the drawings, particularly to FIG. 1, the dehydrating system shown therein includes a belt conveyor V for transferring brown coal K to be dehydrated to a sieving device M. The sieving device M includes a primary sieve $M_1$, a crusher $M_2$ and a secondary sieve $M_3$ and functions to remove fine particles which are unsuitable for the liquid form dehydration. Beneath the sieving device M, there is provided a belt conveyor Q which extends above a series of pressure vessels $A_1$, $A_2$, $A_3$ and $A_4$. The conveyor Q is provided with a tripper R which distributes the material on the conveyor Q to the respective ones of the vessels $A_1$, $A_2$, $A_3$ and $A_4$ at appropriate times. Hoppers $U_1$, $U_2$, $U_3$ and $U_4$ may be provided between the conveyor Q and the vessels $A_1$, $A_2$, $A_3$ and $A_4$, respectively, for receiving the material from the conveyor Q and applying it respectively to the vessels $A_1$, $A_2$, $A_3$ and $A_4$ at desired times.

The vessels $A_1$, $A_2$, $A_3$ and $A_4$ are connected at top portions thereof with a steam source S respectively through valves $D_1$, $D_2$, $D_3$ and $D_4$. The bottom portion of the vessel $A_1$ is connected through a conduit $C_1$ having a valve $B_1$ with the top portion of the vessel $A_2$. Similarly, the vessels $A_2$ and $A_3$ are connected at the bottom portions respectively with the top portions of the vessel $A_3$ and $A_4$ through conduits $C_2$ and $C_3$ having valves $B_2$ and $B_3$. In case where four vessels are provided, the bottom portion of the vessel $A_4$ is connected through a conduit $C_4$ having a valve $B_4$ with the top portion of the vessel $A_1$. Where more than four vessels are used, the bottom portion of the vessel $A_4$ is connected with the top portion of a succeeding vessel. The vessels $A_1$, $A_2$, $A_3$ and $A_4$ are provided at the bottom portions with liquid discharge conduits $E_1$, $E_2$, $E_3$ and $E_4$. Further, the vessels $A_1$, $A_2$, $A_3$ and $A_4$ are provided with depressurizing conduits $G_1$, $G_2$, $G_3$ and $G_4$, respectively, which have valves $F_1$, $F_2$, $F_3$ and $F_4$ and may be passed around the hoppers $U_1$, $U_2$, $U_3$ and $U_4$ as shown in FIG. 1.

In operation, a suitable number of vessels $A_1$, $A_2$, $A_3$ . . . $A_i$ are at first charged with a material to be dehydrated such as brown coal as shown by shadows in FIG. 2. For starting the operation, the vessels are separated from each other by closing the valves $B_1$, $B_2$, $B_3$ . . . $B_i$. The valve $D_1$ is then opened so that steam is supplied to the vessel $A_1$. The steam heats the coal in the vessel $A_1$ and a part of the steam is condensed by giving the heat to the coal. The water in the coal is removed in liquid form by being heated under the atmosphere of saturated steam and mixed with the condensed steam to form hot water. The vessel $A_1$ is thus gradually filled by the hot water and, when the amount of the hot water is increased to a level wherein the coal is completely immersed in the hot water, the valve $B_1$ is opened. Thus, the hot water in the vessel $A_1$ is displaced to the vessel $A_2$ to fill it. In this course of operation, the hot water in the vessel $A_1$ still continues to increase because the condensation of the steam occurs and the dehydration progresses.

As the vessel $A_2$ is filled with the hot water, the valve $B_2$ is opened to allow the hot water therein displaced to the vessel $A_3$. Similar operations are repeated until the vessels $A_2$ through $A_i$ are filled with the hot water. When the vessel $A_i$ is thus filled with water, the discharge valve $E_i$ is opened to expel the displaced water. The level of the hot water in the vessel $A_1$ then gradually decreases and those part of the coal that are exposed to the steam is subjected to dehydration. In the vessels $A_2$ through $A_i$, there takes place preheating of the coal by the displaced hot water.

When it is detected that the hot water is completely exhausted from the vessel $A_1$ or steam is started to enter the vessel $A_2$, the valve $B_1$ is closed and the supply of steam to the vessel $A_1$ is terminated. Then, the valve $F_1$ is opened to depressurize the vessel $A_1$ and the coal is taken out of the vessel $A_1$. During this dehydration cycle, the succeeding vessel $A_{i+1}$ is charged with coal so that a next cycle of dehydration is carried out by closing the valve $E_i$ and opening the valves $B_i$ and $D_2$ so as to introduce the steam to the vessel $A_2$. The next cycle of dehydration is started with the second vessel $A_2$ filled with hot water and the material, and the saturated steam is supplied to the substantially top portion of the second vessel $A_2$. When the vessel $A_{i+1}$ is filled with hot water, the discharge valve $E_{i+1}$ is opened as in the previous cycle of operation.

As described, according to the process, the material in a plurality of vessels is immersed in hot water supplied from a vessel where the dehydration is carried out so that the heat in the hot water is used effectively for preheating the material. In the arrangement shown in FIG. 2, there are certain number of surplus vessels so that one or more of such surplus vessels may be charged with the material while the dehydration is being carried out in one charged vessel to thereby make it possible to start dehydration cycle in a next succeeding vessel as soon as the dehydration in a preceding vessel is completed.

It should, however, be noted that the process may be carried out without providing any such surplus vessels. In such a case, after the dehydrated material is taken out of a vessel, the particular vessel is charged with further material and connected with a preceding vessel to receive a supply of hot water therefrom. In this instance, supply of steam to a succeeding vessel must be delayed until the aforementioned material charge is completed so that there is no movement of the hot water between the vessels. In the conduits between the vessels, the hot water in the lower portion is of a higher temperature than in the higher portion so that there may be a possibility that convections be produced in the conduits. In order to prevent such convection, the conduits may be provided with check valves or the valves $B_1$, $B_2$, . . . $B_i$ in the conduits may be closed in this period. Alternatively, a small amount of flow may be maintained by supplying a corresponding amount of steam to the vessel in which dehydration is to be carried out in the next cycle.

The process in accordance with the present invention may be carried out with only two pressure vessels. In such a case, the vessels are alternately used for dehydration and preheating is performed in the vessel wherein the dehydration is not proceeding. Even with two vessels, an adequate advantage can be obtained because the material under the preheating process is immersed in the hot water so that an effective heat recovery is attained. It should of course be noted that the preheating effect can be increased with an increased number of vessels under the preheating process, however, an excessive number of vessels may result in an increase in the operating time and as a result the thermal efficiency may be decreased due to an increase in heat radiation. Therefore, the number of the vessels should preferably be not greater than twenty. The number of the vessels in which the material is preheated may be determined taking into account the physical property such as the specific heat and the heat conductivity of the material, the water content, the porosity and the particle size of the material and the capacity of the pressure vessel.

According to the present invention, substantial part of heating of the material is conducted in hot water, so that the steam supplied to the vessel may not be saturated one but superheated steam may be used without any significant problem.

It should of course be noted that the process and apparatus of the present invention is not limited to an application to a dehydration of brown coal but it may be applied to any porous organic solid material. Thus, it should be understood that the invention is not limited to the details of the examples as described but changes and modifications may be made without departing from the scope of the appended claims.

We claim:

1. Process for dehydrating organic solid material which comprises the steps of providing a plurality of pressure vessels at least one of which is filled with the material containing water, the material is also immersed in water defining a water level carrying out a dehydration step by supplying steam to said one of the vessels to heat the material therein while removing the immersion water from said one vessel to thereby lower the immersion water level in the one vessel so that the material is gradually exposed to the steam and so that the water in the material is removed and mixed with condensed steam and the remaining immersion water to form hot water, transferring the hot water from said one vessel to a substantially top portion of a second vessel to reheat material charged therein while continuously supplying the steam to said one vessel until said second vessel is substantially filled with the hot water, and then expelling the hot water from a substantially bottom portion of the second vessel by the displacement force of hot water being transferred from the one vessel to the second vessel until the water in the one vessel is exhausted.

2. Process in accordance with claim 1 in which the hot water expelled from the second vessel is transferred further to a suitable number of pressure vessels to fill them in series sequence by taking out the hot water from a substantially bottom portion of a preceding vessel and introducing to a substantially top portion of a succeeding vessel, the hot water in a final pressure vessel, which is in an alternate downstream position, being expelled from a substantially bottom portion thereof.

3. Process in accordance with claim 2 in which said one vessel is isolated from the second vessel after the dehydration step of the one vessel is completed and the second vessel is supplied with steam so that a further dehydration step is carried out in the second vessel.

4. Process in accordance with claim 3 in which a further vessel which is charged with the material is connected in series with said suitable number of pressure vessels so that it is supplied with the hot water which is expelled from the final pressure vessel, the hot water being then expelled from a substantially bottom portion of the said further vessel.

5. Process in accordance with claim 1 in which said one vessel is isolated from the second vessel and depressurized after the dehydration step therein is completed, and the material which has been dehydrated is taken out of the one vessel to complete one cycle of dehydration.

6. Process in accordance with claim 5 in which said one vessel is thereafter charged with the material and steam is supplied to the second vessel to carry out a further cycle of dehydration.

* * * * *